US006859940B1

(12) United States Patent
Sholander

(10) Patent No.: US 6,859,940 B1
(45) Date of Patent: Mar. 1, 2005

(54) SURFER'S WET SUIT SKIRT/WRAP

(76) Inventor: Michael Sholander, 1 Smith Dr., Point Pleasant, NJ (US) 08742

( * ) Notice: Subject to any disclaimer, the term of this patent is extended or adjusted under 35 U.S.C. 154(b) by 0 days.

(21) Appl. No.: 10/725,646

(22) Filed: Dec. 2, 2003

(51) Int. Cl.[7] ..... A41D 13/00
(52) U.S. Cl. ..... 2/69; 2/46; 2/51
(58) Field of Search ..... 2/455–457, 46, 2/51, 47, 88, 89, 48, 69, 69.5, 211, 214, 2.14–2.17, 462.5, 463–467, 79, 82, 81, 102, 108, 109, 115, 135, 217, 242, 272

(56) References Cited

U.S. PATENT DOCUMENTS 3,381,306 A * 5/1968 Innes ..... 2/69
5,611,083 A * 3/1997 Arnold ..... 2/84
6,665,882 B1 * 12/2003 Pedrick ..... 2/228
6,675,389 B1 * 1/2004 Kublick ..... 2/2.17

* cited by examiner

*Primary Examiner*—Gloria M. Hale
(74) *Attorney, Agent, or Firm*—Clifford G. Frayne

(57) ABSTRACT

Applicant's invention is directed to a garment for donning or removing clothing, in particular, a surfer's wetsuit, the garment comprising a tubular skirt/wrap having an open upper end and an open lower end, the open upper end securable about the waist of a surfer, the tubular skirt/wrap having hand and arm apertures formed therein proximate said upper end for insertion of the user's hands and arms for removal and donning of street clothes and removal and donning of a wetsuit, the garment formed of a combination of waterproof and absorbent panels.

15 Claims, 6 Drawing Sheets

SURFER'S WET SUIT SKIRT/WRAP

BACKGROUND OF THE INVENTION

1. Field of the Invention

The present invention relates to a garment, and more particularly, to a skirt or wrap to be worn around the waist by a surfer which allows the surfer to put on and take off the lower portion of a wet suit, on the beach, immediately prior to or immediately after surfing, the skirt or wrap around being formed with a combination of waterproof panels and terry cloth towel-like panels with multiple pockets.

2. Description of the Prior Art

The sport of surfing is enjoyed by millions of surfers world wide. It is a year round sport, even in areas which experience winter-like weather. Further, even in those areas of moderate to tropic climates year round, the water temperature often dictates that the surfer wear a wet suit in order to maintain proper body temperature and to conserve heat. Figures would indicate that world wide, surfers require and wear wet suits during 80 percent of their surfing activities.

Typically a surfer will travel to the beach with their wet suit and surf board to determine the condition of the ocean and the size of the waves. If the surfer determines that surfing is feasible, the surfer must remove his clothing and don a wet suit prior to entering the water. Often times this can be accomplished in a vehicle, but more often than not, depending on access to the beach, the surfer must wrap a series of towels about their waist in order to remove their shorts and pants, and then with the towels still secured about their waist, must then put on the lower portion of the wet suit which is typically made of neoprene or other suitable man-made material, and which is designed to form fit the body, therefore making it more difficult to put on than a normal pair of shorts or trousers.

The reverse situation occurs when the surfer concludes his or her surfing activity. In this situation, if the ambient temperature is extremely cold, the surfer may opt to wear his wet suit home if his or her vehicle is in close proximity. In that situation, the surfer must only concern his or herself with covering the vehicle seat cushion to prevent it from becoming wet. Applicant's invention has application to this situation. However, the majority of the time, the surfer after concluding surfing activities desires to remove his wet suit while in close proximity to the beach and ocean. Again, in the past, this required the surfer to utilize a variety of towels wrapped about the waist to allow the surfer to remove the lower portion of the wet suit, dry off his torso, and then don his regular clothes, all while being wrapped in one or more towels.

While the procedure just described was acceptable to surfers, it was an unwieldy and cumbersome exercise requiring the surfer to transport not only his surfboard and wet suit, but a sufficient quantity of towels and a repository to place his street clothes in while surfing, and a repository to place the dampened wet suit after surfing.

Applicant has developed a garment in the form of a skirt or wrap which incorporates terrycloth or towel-like panels with panels of waterproof material, which may be worn about the waist to allow a surfer to don and remove the lower portion of his wet suit. The garment also contains sufficient pockets with closure to store valuables and street clothing while engaging in surfing activity and also serve as a repository for the damp wet suit when the surfing activity is concluded. The garment fits snugly about the surfer's waist and allows access to the lower portion of the wet suit beneath the garment.

OBJECTS OF THE INVENTION

An object of the present invention is to provide for a garment for surfers which allows the surfer to put on and remove the lower portion of his wet suit in modesty while on a public beach.

A further object of the present invention is to provide for a novel garment which incorporates terrycloth towel-like panels with waterproof panels which combine to allow the surfer to dry himself and to store street clothing or the dampened wet suit.

A still further object of the present invention is to provide for a novel garment for surfers which negates the need for the surfer to bring multiple towels and containers to the beach with his or her surfboard in order to store valuables and street clothing while surfing and to hold the dampened wet suit when surfing activities are completed.

A still further object of the present invention is to provide for a novel garment which may be slipped on about the waist and secured by a draw string or wrapped about the waist and secured by a suitable fastening means such as hook and loop fasteners or the like.

SUMMARY OF THE INVENTION

A garment for donning or removing clothing, in particular, a surfer's wetsuit comprising a tubular skirt/wrap having an open upper end and an open lower end, said open upper end securable about the waist of a surfer, said tubular skirt/wrap having hand and arm apertures formed therein proximate said upper end for insertion of said user's hands and arms for removal and donning of street clothes and removal and donning of a wetsuit, said tubular skirt/wrap further comprising a front waterproof panel having a top edge, bottom edge and opposing side edges; a two-ply rear panel comprised of two waterproof overlaid panels having a top edge, bottom edge, and opposing side edges, said bottom edges and said side edges secured to form a pocket with a closure means along said top edge, said front waterproof panel and said two-ply back panel secured to each other along their side edges thereby forming a tubular wrap, said front waterproof panel or said two ply rear panel overlaid with an absorbent panel and secured thereto.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 2:
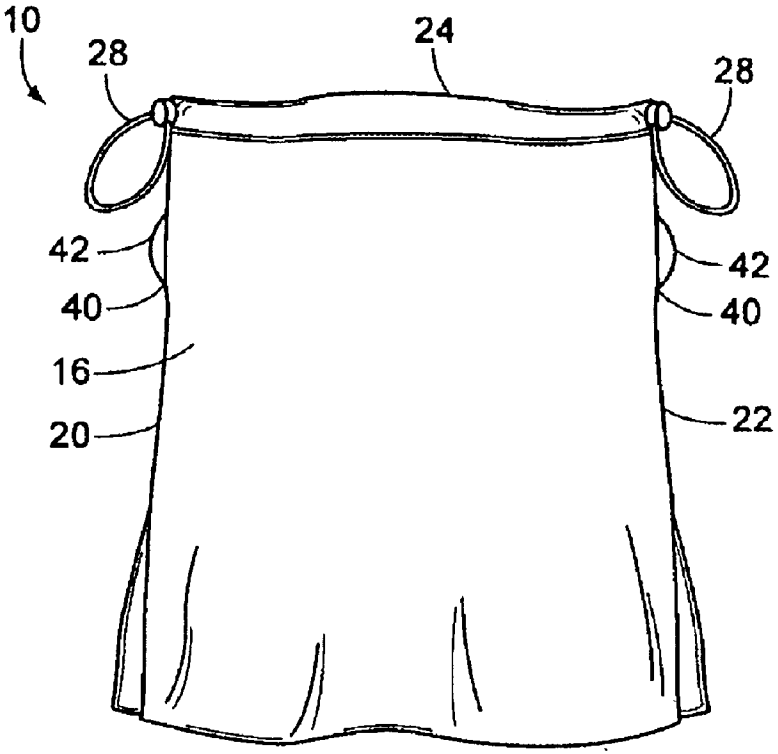
FIG. 2 is a rear view of a first embodiment of the garment of the present invention.
Figure 1:
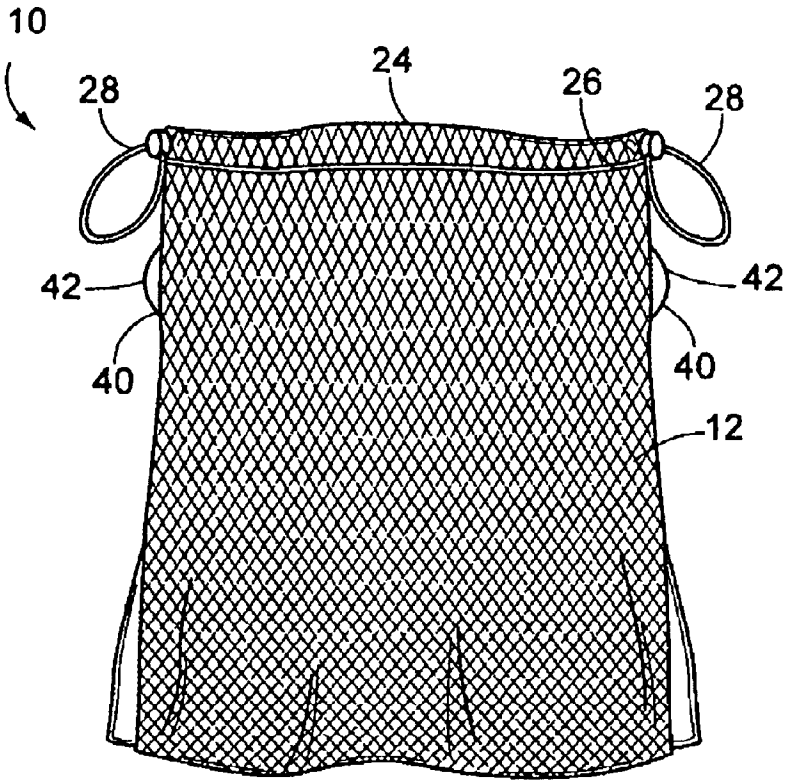
FIG. 1 is a front view of a first embodiment of the present garment invention.
Figure 4:
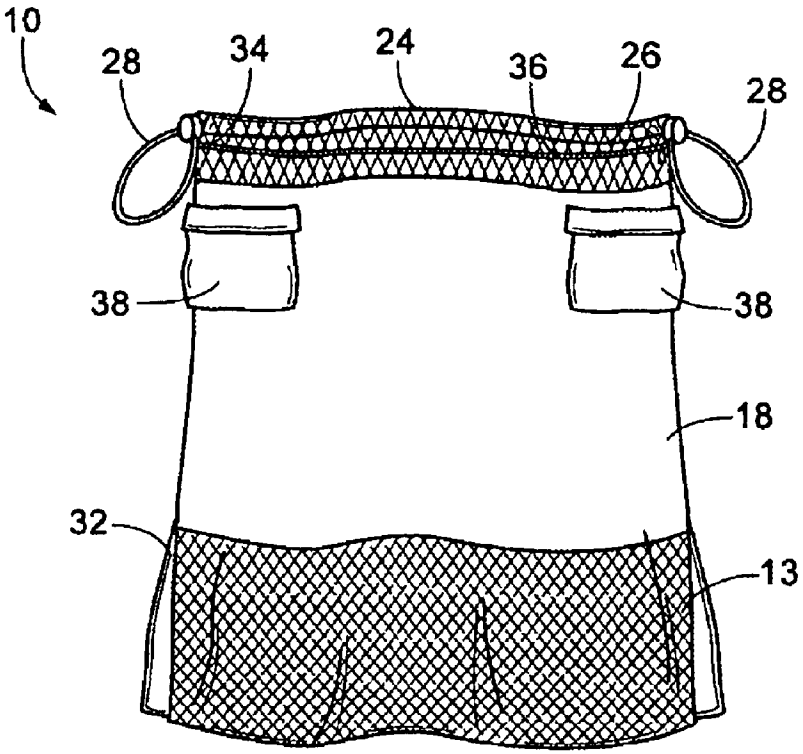
FIG. 4 is a rear view of a first embodiment of the garment of the present invention in a reversible mode.
Figure 3:
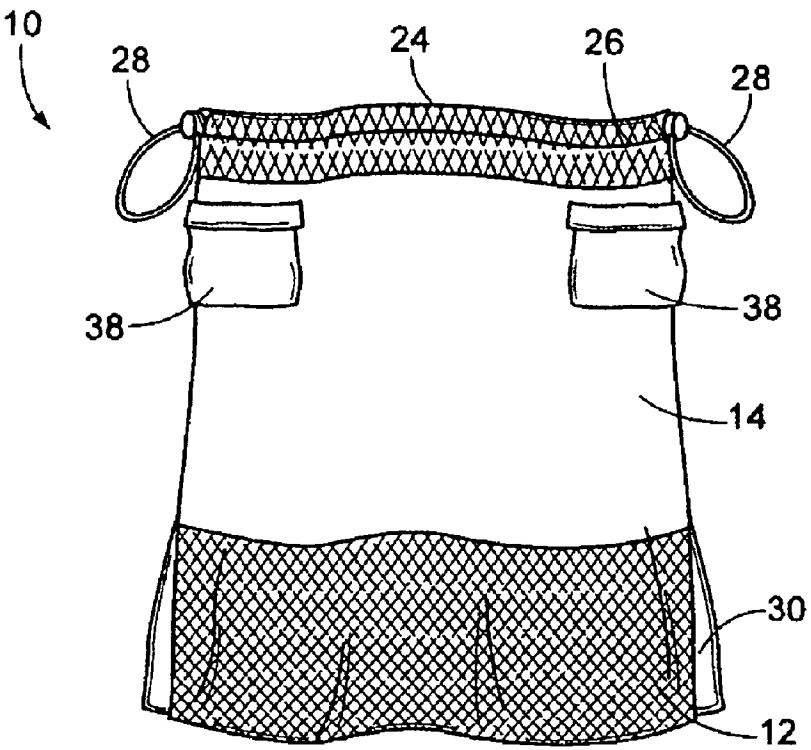
FIG. 3 is a front view of the first embodiment of the garment of the present invention in a reversible mode.
Figure 5:
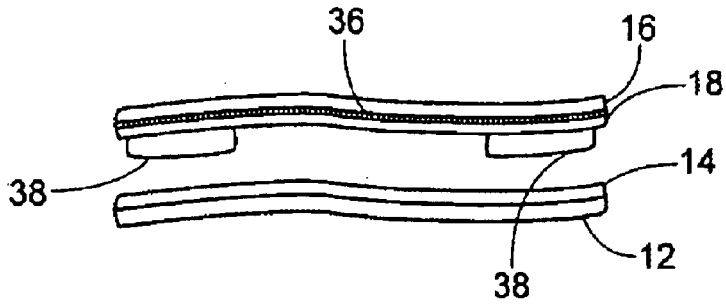
FIG. 5 is a top cutaway view of the first embodiment of the garment of the present invention.

FIGS. 1, 2, 3, and 4 are front and rear views of a first embodiment of the garment 10 of the present invention, FIGS. 1 and 2 showing it in one mode and FIGS. 3 and 4 showing it in a reversed mode. In FIG. 1 there is illustrated the garment 10 of the present invention in what we will selectively call a front view. Garment 10 is comprised of an absorbent panel 12 which is overlaid and secured to an underlying waterproof panel 14 as best illustrated in FIG. 5. FIG. 2 is a rear view of a first embodiment of the garment of the present invention which is comprised of two waterproof panels 16 and 18 as best illustrated in FIG. 5. The panels 16 and 18 and 14 and 12 are secured along their side edges 20 and 22 so as to form a skirt. The upper ends collectively referred to as 24 are folded over to form a waist band 26 which includes a casing channel (not shown) in which a drawstring 28 is secured.

FIGS. 3 and 4 are a front and rear view of the first embodiment of the present invention in a reversible mode. The reversible view of the front panel as illustrated in FIG. 3 illustrates waterproof panel 14 which is secured to absorbent panel 12. In this embodiment, the absorbent panel 12 overlaps a bottom margin 30 of waterproof panel 14. Again, the waistband and casing 24 and 26 are illustrated in which drawstring 28 is secured. FIG. 4 is a reversible view of the rear panels 16 and 18 of garment 10. A second absorbent panel 13 overlaps panels 16 and 18 along the lower margin 32 of panels 16 and 18. Panels 16 and 18 define a pocket therebetween accessed by means of a slit aperture 34 positioned proximate casing 26 and secured by a suitable fastening means 36 such as a hook and loop fastener or zipper. Additional pockets 38 may also be formed on the interior of garment 10 with suitable closure means such as hook and loop fasteners in order to store valuables or the like.

FIG. 5 is a top view wherein waterproof panels 16 and 18 and waterproof panel 14 and absorbent panel 12 have not yet been secured along their opposing side edges 20 and 22 thereby providing a top view of the arrangement of the panels and the fastening means allowing access to the pocket formed between waterproof panels 16 and 18. This pocket 36 is designed to store clothing removed so as to don a wetsuit and in the reverse, is designed to store the damp wet suit when the surfing activity has been completed.

Figure 6:
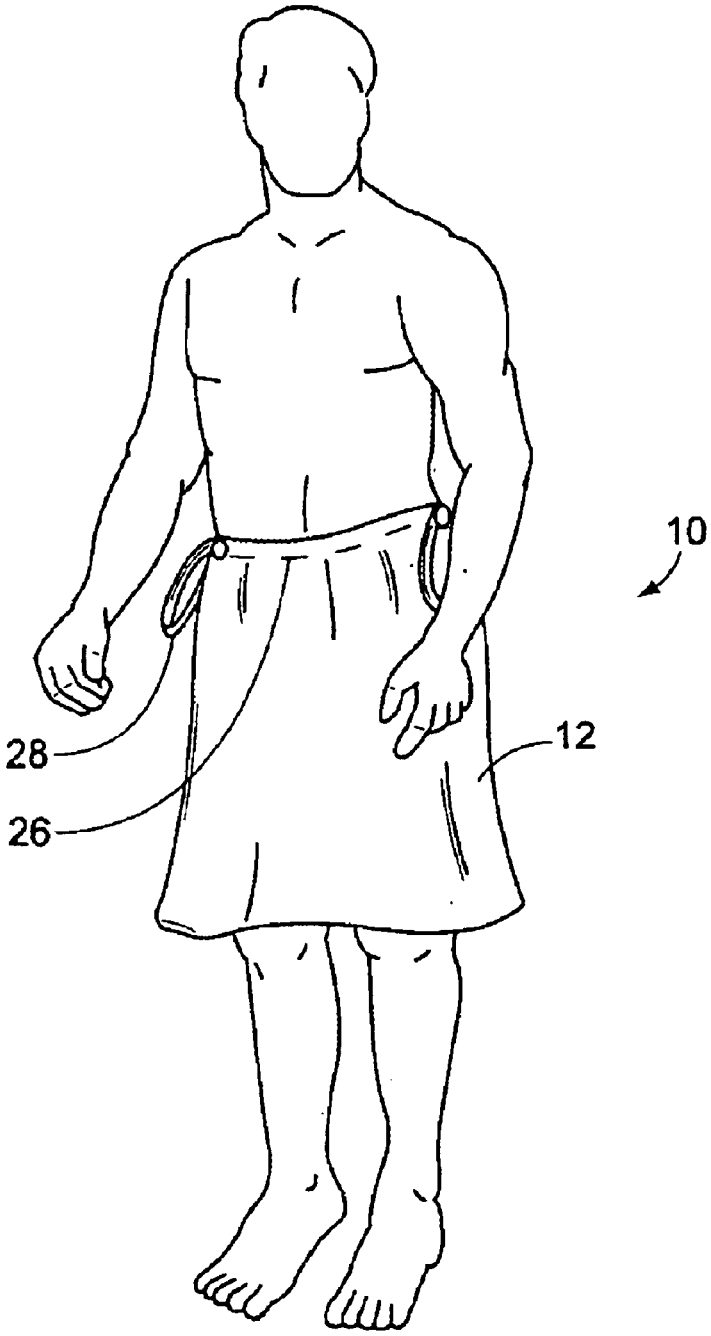
FIG. 6 is a front view of an individual wearing a garment of the present invention.
Figure 7:
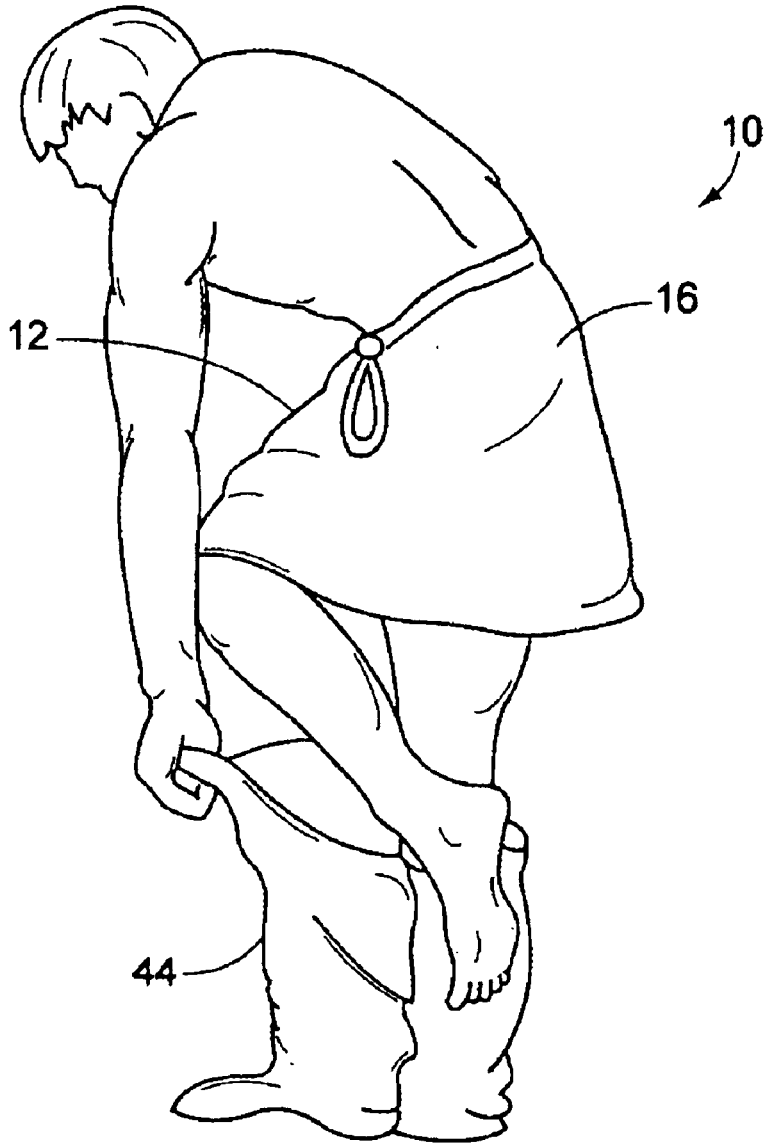
FIG. 7 is a perspective view of an individual wearing the garment of the present invention in the process of putting on a wet suit.
Figure 8:
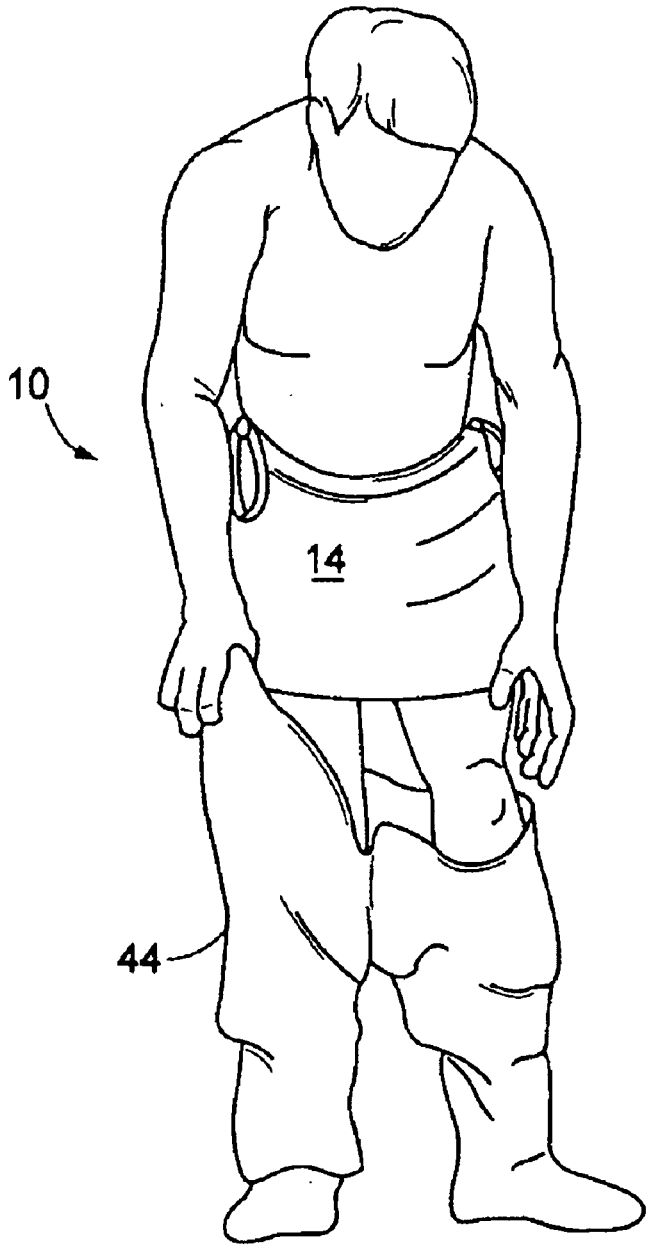
FIG. 8 is a perspective view of an individual removing a wet suit.

Referring to FIGS. 6, 7, and 8, there is illustrated the garment 10 of the present invention being utilized by an individual. FIG. 6 illustrates the manner in which the garment 10 is worn about the waist of the individual and secured snuggly by drawstrings 28 within waistband 26. In this illustration, garment 10 is being worn in the mode illustrated in FIGS. 1 and 2 with the absorbent panel 12 facing outwardly. In this configuration, the individual might have just removed his clothing from the lower torso by reaching through apertures 40 formed in the seam along the opposing side edges where panels 12, 14, 16, and 18 are joined. These apertures 40 are covered by an aperture flap 42 and allows the individual insert, his hands and arms under the garment 10 in order to loosen the belt or other securing means to the user's street clothes and allow them to drop to the ground.

FIG. 7 illustrates the next process in the utilization of garment 10. In this illustration, the user with garment 10 still in the configuration as illustrated in FIG. 6, dons the leg portion 44 of a surfer's wetsuit. The user is able to maneuver the leg portion 44 of the wetsuit up about his waist utilizing the apertures 40 formed in the seam between panels 12 and 14 and 16 and 18. Once the leg portion 44 of the wetsuit is in position, the user can remove garment 10.

FIG. 8 illustrates the next step in the utilization of garment 10. The user has completed surfing and now wishes to remove the wetsuit. The user dons the garment 10 in a reverse mode as illustrated in FIGS. 3 and 4 wherein panels 12 and 16 are adjacent the body. The surfer then utilizes apertures 40 to maneuver the leg portion 44 of the wetsuit off of the body. Since the absorbent panel 12 is in the reversed mode and adjacent the body, the surfer can utilize the absorbent panel 12 as well as that portion of absorbent panel 12 and 13 which overlaps panels 14 and 18 to dry his body. The user can then don the street clothes which were removed prior to the surfing act ivity.

There are other embodiments of Applicant's invention which will be discussed, but it should be remembered that in all of the embodiments, the utilization of the garment 10 remains the same as illustrated and discussed in FIGS. 6, 7, and 8.

Figure 9:
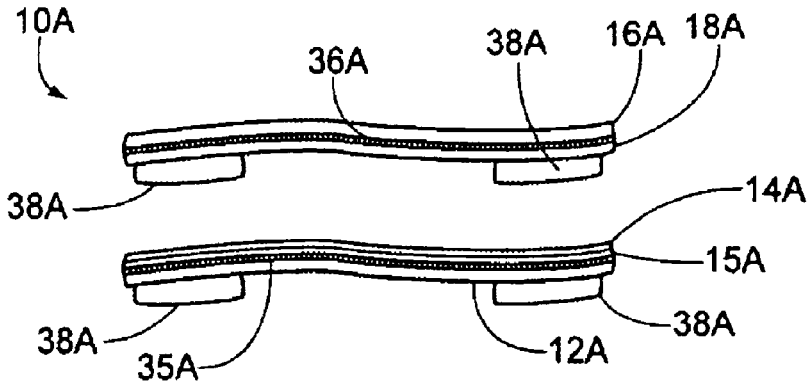
FIG. 9 is a top cutaway view of a second embodiment of the present invention.

FIG. 9 is a top view of an arrangement of panels for a second embodiment of the garment identified as 10A. In this embodiment, the rear of garment 10A is comprised of two waterproof panels 16A and 19A secured along their bottom and opposing side edges and forming a pocket therebetween having a slit aperture and closure means 36A for securing said pocket. The front panel comprises a first waterproof panel 14A and a second waterproof panel 15A overlaid with absorbent panel 12A. In this configuration, a second pocket is formed in the front portion of the garment 10 between waterproof panels 14A and 15A having a closure means 35A, similar to closure means 36A for forming a pocket for the storage of clothing or the like. As with the first embodiment, a plurality of additional pockets 38A with suitable closure means could be formed on the interior or exterior of the panels to allow for storage of other valuables or the like. As illustrated in FIG. 9, when the panels 16A and 18A are secured to panels 14A, 15A, and 12A along their opposing edges, they would form the garment 10 as illustrated in FIGS. 1 through 4 and 6 through 8. The only difference in this embodiment is that the front panel incorporates two waterproof panels 14A and 15A to provide for the forming of a second waterproof pocket.

Figure 10:
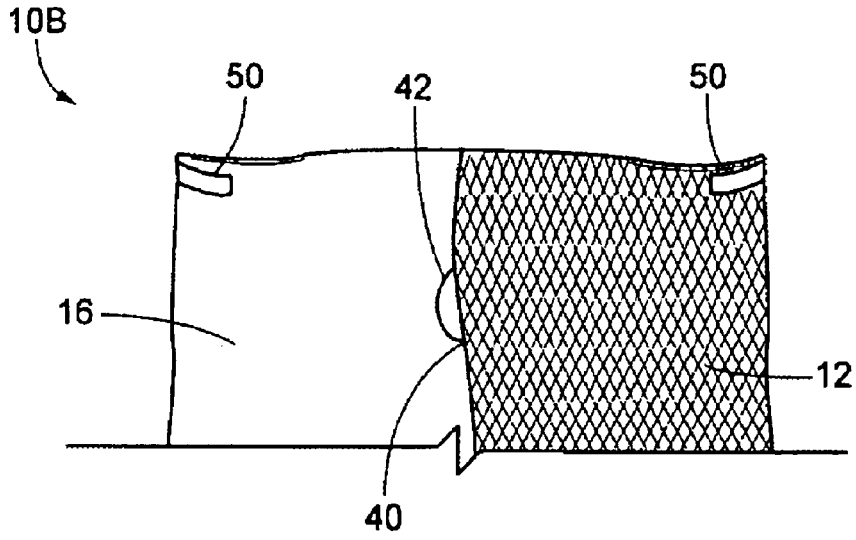
FIG. 10 is a front view of a third embodiment of the present invention.

In a third embodiment of the garment of the present invention identified as 10B and illustrated in FIG. 10, the garment 10B is in the form of a wrap. The configuration of the panels and the pockets could be the same as that illustrated in either FIG. 5 or FIG. 9. However, in this configuration 10B, there is no waistband, casing or pull string, but rather, the panels are essentially secured along one of the side edges and the opposing side edges are provided with a fastening means 50 in the form of a hook and loop fastener. The garment 10B still remains reversible and still maintains the construction as illustrated in FIGS. 5 and 9 and is still utilized in the same manner as illustrated in FIGS. 6, 7, and 8. However, it is secured about the waist, not by a drawstring 28, but rather by the fastening means 50 such as a hook and loop fastener.

While the garment has been described with respect to its application to the sport of surfing, it will be recognized that the garment has application to any outdoor sport wherein the participant finds it convenient or necessary to change clothing in a public or semi-public open area.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. A garment utilized for donning or removing clothing, in particular, a surfer's wetsuit, said garment comprising:

a tubular skirt/wrap having an open upper end and an open lower end, said open upper end securable about the waist of a user, said tubular skirt/wrap having hand and arm apertures formed therein proximate said upper end for insertion of said user's hands and arms beneath said garment for removal and donning of street clothes and removal and donning of a leg portion of a wet suit, said tubular skirt/wrap further comprising;

a front waterproof panel having a top edge, bottom edge, and opposing side edges;

a two-ply rear panel comprised of two waterproof overlaid panels each having a top edge, bottom edge and opposing side edges, said two waterproof panels of said two-ply rear panel being secured along the bottom edge and opposing side edges, said side edges of said front panel and said two-ply rear panel secured to form said tubular skirt/wrap, said side edges having apertures formed therein for insertion of said hands and arms, said two-ply, waterproof rear panel having a first primary pocket formed therebetween with closure means proximate to said top end; and an absorbent panel overlaid and secured to said front or rear panel.

2. The garment in accordance with claim 1 wherein said open upper end has formed therein, a waistband formed by an overlay fold of said front and rear panels and said absorbent panel to form a casing having a drawstring positioned therein.

3. The garment in accordance with claim 1 wherein one side edge of said front waterproof panel and said rear waterproof panel is unsecured to each other to form a wrap having a securing means proximate said upper end for wrapping and securing about said user's waist.

4. The garment in accordance with claim 3 wherein said securing means comprises a hook and loop fastener.

5. The garment in accordance with claim 1 further including a plurality of secondary pockets with closures for storage of valuables.

6. The garment in accordance with claim 1 wherein said first primary pocket formed between said two-ply rear panel is sized for storage and transport of a damp wetsuit.

7. The garment in accordance with claim 1 wherein said garment is reversible allowing said user to wear said garment with said waterproof panels positioned inwardly for removal of said street clothes and donning said wet suit and reversed with said absorbent panel positioned inwardly for removal of said leg portion of said wet suit, drying of said user's lower body, and the donning of street clothes.

8. The garment in accordance with claim 3 wherein said front waterproof panel is two-ply having formed therebetween a second primary pocket with closure means formed proximate said top edge thereof for storage of said street clothes or said leg portion of said wet suit.

9. The garment in accordance with claim 1 wherein said absorbent panel overlaps said front waterproof panel and said rear waterproof panel along said lower edges.

10. The garment in accordance with claim 1 wherein said absorbent panel material is terry cloth.

11. A garment for donning or removing clothing, in particular, a surfer's wetsuit comprising:

a tubular skirt/wrap having an open upper end and an open lower end, said open upper end securable about the waist of a surfer, said tubular skirt/wrap having hand and arm apertures formed therein proximate said upper end for insertion of said user's hands and arms for removal and donning of street clothes and removal and donning of a wetsuit, said tubular skirt/wrap further comprising a front waterproof panel having a top edge, bottom edge and opposing side edges; a two-ply rear panel comprised of two waterproof overlaid panels having a top edge, bottom edge, and opposing side edges, said bottom edges and said side edges secured to form a pocket with a closure means along said top edge, said front waterproof panel and said two-ply back panel secured to each other along their side edges thereby forming a tubular wrap, said front waterproof panel or said two ply rear panel overlaid with an absorbent panel and secured thereto.

12. The garment in accordance with claim 11 wherein said open upper end is formed with a waistband formed by an overlay fold of said front and rear waterproof panels and said absorbent panel to form a casing having a drawstring positioned therein.

13. The garment in accordance with claim 11 wherein one side edge of said front and rear panels is unsecured to each other to form a wrap having a securable means proximate said upper end for wrapping and securing about said user's waist.

14. The garment in accordance with claim 11 wherein said garment is reversible, allowing said user to wear said garment with said waterproof panels positioned inwardly for the removal of said street clothes and donning of said wetsuit and reversed with said absorbent panel positioned inwardly for removal of said leg portion of said wetsuit, drying of said user's lower body, and donning of said street clothes.

15. A method for removing and donning clothing on a beach, and in particular for removing and donning street clothes and donning and removing the leg portion of a wet suit, the method comprising:

forming a tubular skirt/wrap having an open upper end and an open lower end, said open upper end securable about the waist of the surfer, said tubular skirt/wrap having hand and arm apertures formed therein proximate said upper end for insertion of said user's hands and arms for removal and donning of street clothes and removal and donning of a wet suit, said tubular skirt/wrap having a front waterproof panel and a two-ply waterproof rear panel secured along their side edges, said two-ply rear panel forming a pocket therebetween having a closure means approximate said upper end of said tubular skirt/wrap, said front panel or said rear panel having a water absorbent panel overlaid and secured thereto;

positioning said tubular skirt/wrap about said waist of a user and over said street clothes with said waterproof front panel and two-ply waterproof rear panel facing inwardly;

removing said street clothing from said lower portion of said user's body;

donning said leg portion of said wetsuit;

removing said tubular skirt/wrap;

reversing said tubular skirt/wrap positioning said absorbent panel inwardly;

donning said tubular skirt/wrap;

removing said leg portion of said wetsuit and donning said street clothes;

removing said tubular skirt/wrap and positioning said damp wetsuit in said pocket formed between two-ply rear panel.

* * * * *